US005662684A

United States Patent [19]

Caso

[11] Patent Number: 5,662,684

[45] Date of Patent: Sep. 2, 1997

[54] LIQUID DISPENSING PACIFIER APPARATUS

[76] Inventor: Jeffrey S. Caso, 418 Merrick Ave., Merrick, N.Y. 11566

[21] Appl. No.: 581,774

[22] Filed: Jan. 2, 1996

[51] Int. Cl.[6] ..... B65D 1/40; A61J 9/00

[52] U.S. Cl. ..... 606/234; 215/2; 215/11.6; 606/236

[58] Field of Search ..... 606/234–236; 604/77; 215/11.1–11.6

[56] References Cited

U.S. PATENT DOCUMENTS

| | | | |
|---|---|---|---|
| 1,771,838 | 7/1930 | Bierbichler | 215/11.3 |
| 2,517,457 | 8/1950 | Allen | 215/11.3 |
| 2,899,110 | 8/1959 | Parker | 215/2 |
| 3,143,429 | 8/1964 | Swanson et al. | 215/11.3 |
| 3,604,491 | 9/1971 | Spiess | 150/1 |
| 3,735,888 | 5/1973 | Jacko | 215/11 B |
| 3,768,683 | 10/1973 | Van Den Bosch | 215/11.6 |
| 3,826,409 | 7/1974 | Chilcoate | 222/92 |
| 4,466,547 | 8/1984 | Klittich | 215/11 E |
| 4,813,556 | 3/1989 | Lawrence | 215/11.3 |
| 4,850,496 | 7/1989 | Rudell et al. | 215/11.1 X |
| 4,959,051 | 9/1990 | Glass et al. | 606/234 X |
| 5,044,509 | 9/1991 | Petrosky et al. | 215/11.1 |
| 5,176,706 | 1/1993 | Noble | 606/234 |
| 5,201,438 | 4/1993 | Norwood | 215/11.3 X |
| 5,209,372 | 5/1993 | Norwood | 215/11.3 X |
| 5,244,122 | 9/1993 | Botts | 215/11.1 |
| 5,273,171 | 12/1993 | Steele-Rowland | 215/11.1 |
| 5,300,024 | 4/1994 | Yang | 606/234 |
| 5,431,680 | 7/1995 | Jones | 606/234 |
| 5,499,729 | 3/1996 | Greenwood et al. | 215/11.5 |
| 5,512,047 | 4/1996 | Dvorak | 606/236 X |

FOREIGN PATENT DOCUMENTS

| | | | |
|---|---|---|---|
| 1451691 | 9/1966 | France | 215/11.5 |
| 2238729 | 6/1991 | United Kingdom | 215/11.5 |
| 8301381 | 4/1983 | WIPO | 215/11.4 |

*Primary Examiner*—Michael Buiz
*Assistant Examiner*—Nancy Mulcare
*Attorney, Agent, or Firm*—Goldstein & Associates

[57] ABSTRACT

A liquid dispensing pacifier comprising a body having a proximal end and a distal end, and a nipple base defining the proximal end. A resilient nipple is affixed to and extends outward from the nipple base. An aperture base defines the distal end of the body, and an aperture is affixed to and extends from the aperture base. A reservoir is located within the body, and is in fluid communication with the resilient nipple. A plurality of pleats are disposed along the body which permit the body to collapse and compress in response to an infant withdrawing fluid from the reservoir via the resilient nipple.

4 Claims, 2 Drawing Sheets

LIQUID DISPENSING PACIFIER APPARATUS

BACKGROUND OF THE INVENTION

The invention relates to a liquid dispensing pacifier apparatus. More particularly, the invention relates to a child's pacifier which functions both as a liquid dispensing oral cleansing device as well as a standard child pacifier for suckling.

Due to recommendations of family pediatricians, a recent trend has emerged which advocates a continuous liquid, non-solid diet well into the child's first year. The resultant downside to this recent dietary trend is twofold. Initially, said diet can prove detrimental to an infant's oral hygiene. In addition, said diet can cause an infant to become dependent upon a formula bottle.

Fermentable carbohydrates, present in most children's formula, can foster the growth of acidogenic microorganisms on the surface of an infant's teeth. Without the beneficial "cleansing action" which results upon the teeth from the chewing of solid foods, a buildup of such microorganisms and other bacterial colonies results, leading to plaque and subsequent dental cavities.

Furthermore, the implementation of a non-solid food diet causes an infant to become accustomed to his or her bottle and the liquid sensation derived therefrom when drinking formula or juice from said bottle. As a result, a "bottle habit" is formed, and the infant will be restless and unable to sleep unless provided with a liquid filled bottle. A traditional pacifier will not satisfy the infant since it is the liquid sensation which the child craves in conjunction with the suckling action. Allowing the child to sleep with a liquid filled bottle is similarly not a viable alternative, since air is often ingested by the infant when sucking on such a bottle and the ingestion of air at night might cause gas or digestive problems for the infant, causing further sleeplessness and restlessness.

Various references are disclosed in the prior art which contemplate an assortment of pacifier-related devices. These devices, however, primarily function to dispense medications to infants or provide enhanced soothing. U.S. Pat. No. 5,127,903 to Mailot et al., U.S. Pat. No. 5,123,915 to Miller et al. and U.S. Pat. No. 2,612,165 to Szuderski all disclose pacifier devices having a chamber located therein to receive a medication tablet or capsule. U.S. Pat. No. 5,197,974 to Scarpelli et al. discloses a liquid filled (but not dispensing) pacifier apparatus capable of being heated or chilled to soothe an infant suffering from oral discomfort. Finally, U.S. Pat. No. 4,192,307 to Baer discloses a pacifier similar to the medication dispensing pacifiers discussed above, wherein said pacifier is configured to receive and subsequently dispense small volumes of sweetened candy or juice.

It is evident that these devices do not alleviate the problems discussed above in that they do not provide for the dispensing of adequate volumes of liquid to an infant. The Mailot, Miller and Szuderski references fail to provide for the dispensing of any liquids aside from the infant's own saliva which is used to bathe and dissolve the medicament. In the Scarpelli reference, the device is a sealed liquid filled device, with the liquid employed only to provide warming or chilling soothing effects for the infant. No liquid is dispensed in the Scarpelli reference. Similarly, the Baer reference contemplates dispensing minuscule volumes of candy or juice by bathing said candy or juice in the infant's saliva. It does not contemplate dispensing any significant amount of liquid to the infant. Furthermore, such device possesses ventilating holes which allow the infant, as is the case with the other apparatus discussed above, to ingest air and hence suffer from gas and other digestive discomfort.

Accordingly, while these units discussed above may be suitable for the particular purpose employed, or for general use, they would not be as suitable for the purposes of the present invention as disclosed hereafter.

SUMMARY OF THE INVENTION

It is an object of the invention to produce a liquid dispensing pacifier.

It is another object of the invention to produce a child's pacifier which functions both as a liquid dispensing oral cleansing device as well as a standard child pacifier for suckling.

It is a further object of the invention to produce a pacifier having a reservoir located therein capable of storing and dispensing liquid to a child who may be sucking on said pacifier.

It is a still further object of the invention to produce a liquid dispensing pacifier capable of dispensing water and/or a fluoridated solution to a child in order to wash and cleanse the child's teeth and, when a fluoride solution is utilized, act as a bacteriostatic agent to prevent bacterial buildup.

It is another object of the invention to provide a liquid dispensing pacifier which has an air-tight fluid reservoir and is collapsible such that upon withdrawing liquid from the reservoir of the pacifier, said pacifier compresses and collapses, thus preventing the infant from ingesting any air.

It is a further object of the invention to produce a pacifier which, upon collapsing in response to the infant's withdrawal of fluids therefrom, appears and functions like a standard infant pacifier.

It is yet another object of the invention to produce a liquid dispensing pacifier which can be utilized as a weaning nipple to wean a nighttime liquid formula dependent infant off of the infant's desire for a formula filled bottle. By filling the reservoir of the pacifier with a solution of water and formula and then progressively diluting the concentration of formula with water until eventually only water is being supplied to the infant, the infant will consequently be weaned off of the formula, and be receiving only water which acts to beneficially wash and cleanse the infant's oral cavity overnight. No air will be ingested by the infant due to the air-tight collapsible nature of the pacifier as discussed above. Furthermore, once collapsed, the liquid dispensing pacifier will appear and function identically to a traditional pacifier.

The invention is liquid dispensing pacifier comprising a body having a proximal end and a distal end, a nipple base defining said proximal end, said nipple base having a resilient nipple affixed to and extending outward from said nipple base, an aperture base defining the distal end of the body and an aperture affixed to and extending from said aperture base, a reservoir located within the body in fluid communication with the resilient nipple, and a plurality of pleats disposed along the body which permit said body to collapse and compress in response to an infant withdrawing fluid from the reservoir via the resilient nipple.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
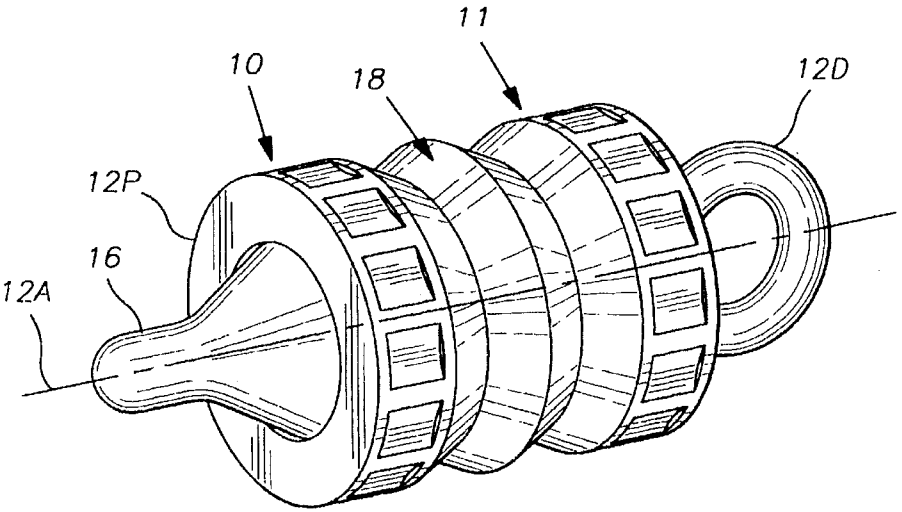
FIG. 1 is a diagrammatic perspective view of the instant invention.

FIG. 1 illustrates a liquid dispensing pacifier 10. Said liquid dispensing pacifier 10 comprises a body 11, which has a proximal end 12P and a distal end 12D located opposite therefrom. A proximal-distal axis 12A extends horizontally through the liquid dispensing pacifier 10 between said proximal end 12D and said distal end 12D. A nipple base 14 having a plane which extends transverse to the proximal-distal axis 12A defines the proximal end 12D of the body 11 of the liquid dispensing pacifier 10. Said nipple base 14 is circular in shape. A resilient nipple 16, circular in shape and having a diameter smaller than that of the nipple base 14, is fixed concentrically to said nipple base 14, and extends outward therefrom, away from the body 11.

Figures 3, 4, 5:
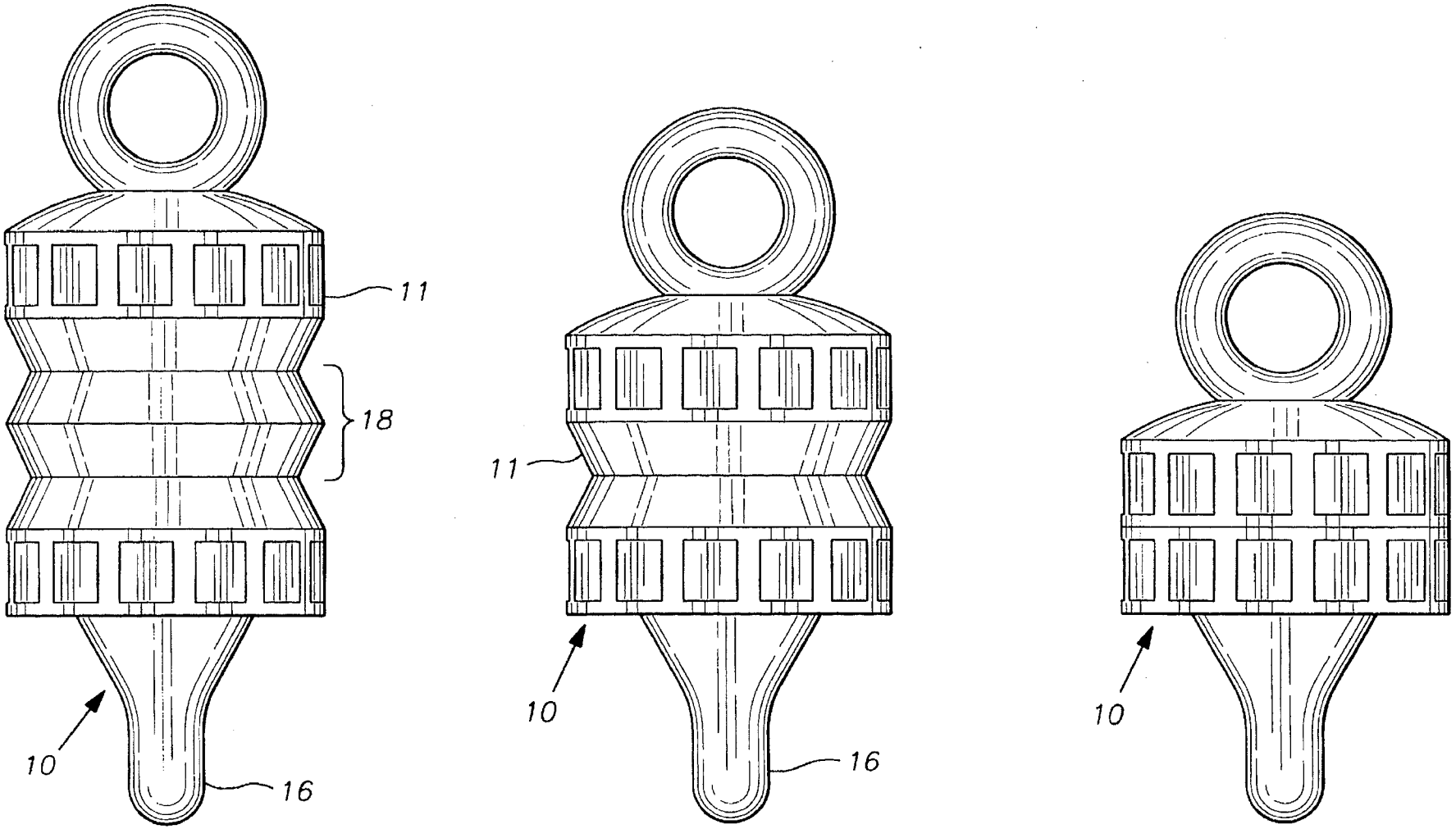
FIG. 3 is a side view of the instant invention in a fully extended, uncollapsed position.
FIG. 4 is a side view of the instant invention partially collapsed.
FIG. 5 is a side view of the instant invention fully collapsed and compressed.

The body 11 of the liquid dispensing pacifier 10 is made of a flexible plastic having a plurality of pleats 18 located between the proximal end 12P and the distal end 12D, thus providing for adjustment of the length of the body 11. Illustrated in FIG. 2, it can be seen that the pleats 18 are circular in shape and each comprise a major fold line 20 and two minor fold lines 22. Each minor fold line 22 is shared in common with an adjoining pleat 18. The major fold line 20 is larger in diameter than the minor fold line 22, and both fold lines are concentric to each other. The shape of said pleats 18, and hence the body 11 itself, can also be rectangular or any other shape which effectively permits said pleats to compress and allow the body 11 to collapse into a compact position as shown in FIGS. 3 through 5.

Figure 2:
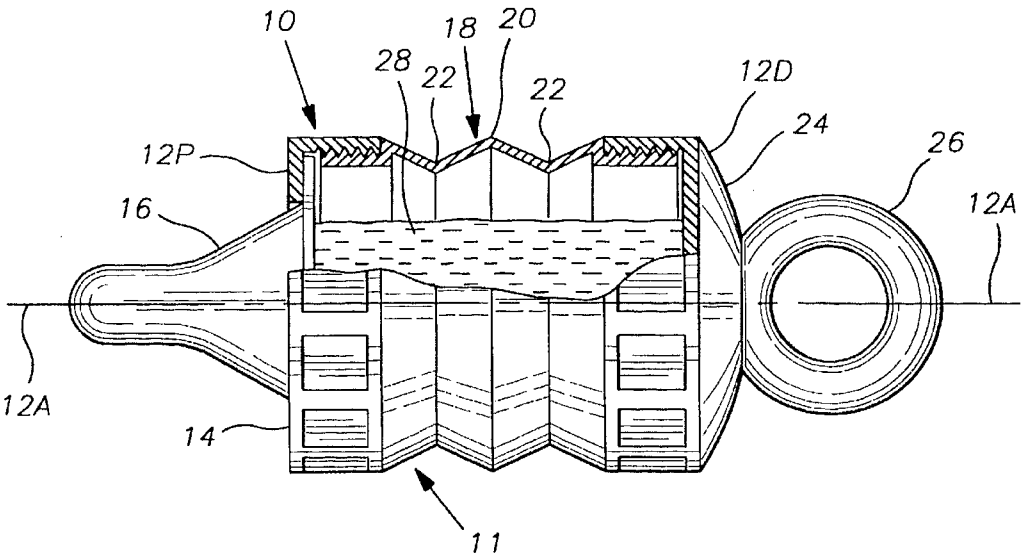
FIG. 2 is a side view of the instant invention with a section broken away to illustrate an interior reservoir.

As seen in FIG. 2, an aperture base 24, circular in shape, defines the distal end 12D of the body 11 of the liquid dispensing pacifier 10, and conforms to the round shape of said body 11. The plane of the aperture base 24 is transverse to the proximal-distal axis 12A of the body 11. The aperture base 24 as depicted in FIG. 2 has the same diameter as the nipple base 14 located at the proximal end 12P of the body 11. The two bases are also concentric to each other. It should be noted that said bases can also be rectangular, oval, or any other variety of shapes. Similarly, as mentioned above, the shape of the pleats 18 can also vary, thus varying the overall shape of the body 11 of the liquid dispensing pacifier 10. In order to maintain a uniform shape of the liquid dispensing pacifier 10, it is preferable, though not required, to cause the nipple base 14, aperture base 24 and body 11 to have equivalent shapes.

An aperture 26 extends outward from the aperture base 24, away from the body 11 of the liquid dispensing pacifier 10. Said aperture 26 provides a loop or handle for an infant to grasp when using the liquid dispensing pacifier 10.

A reservoir 28 is contained within the body 11 of the liquid dispensing pacifier 10. The resilient nipple 16 which extends from the nipple base 14 is in fluid communication with the reservoir 28. The aperture base 24 is removable from the body 11, thus exposing the reservoir 28 and allowing said reservoir 28 to be filled with water or a similar cleansing fluid. When the aperture base 24 is installed upon the body 11 of the liquid dispensing pacifier 10, the reservoir 28 is sealed air-tight.

FIGS. 3 through 5 illustrate the collapsible nature of the liquid dispensing pacifier 10. As an infant sucks on the resilient nipple 16, liquid is drawn therethrough from the supply of liquid stored in the reservoir 28. Due to the fact that the reservoir 28 is sealed air-tight, the pleats 18 of the body 11 tend to compress in response to the infant drawing fluid from the reservoir 28. As more and more liquid is withdrawn from the reservoir 28, the body 11 begins to collapse as shown in FIG. 4. Eventually, upon the withdrawal of all of the liquid from the reservoir 28, the body 11 fully collapses as seen in FIG. 5, thus causing the liquid dispensing pacifier 10 to appear and function like a standard infant pacifier. Furthermore, due to the air-tight nature of the reservoir 28, an infant who is sucking upon the resilient nipple 16 and removing fluids therethrough will not ingest any air, and thus not be exposed to potential digestive troubles which cause discomfort and restlessness in an infant.

What is claimed is:

1. A liquid dispensing pacifier comprising:

a) a body having a proximal end, a distal end and a proximal-distal axis extending between said ends, b) a nipple base having a plane which extends transverse to the proximal-distal axis and defines the proximal end of said body;

c) a resilient nipple affixed to said nipple base extending outward therefrom, away from said body;

d) an aperture base having a plane which extends transverse to the proximal-distal axis and defines the distal end of said body;

e) an aperture extending outward from the aperture base away from the body, the aperture forming a loop having a plane which extends perpendicular to the plane of the aperture base and functions as a handle to be grasped by an infant; and f) a reservoir for storing fluids, said reservoir in fluid communication with the resilient nipple and located within the body, wherein the body further comprises a plurality of pleats located between the proximal end and the distal end of the body, said pleats circular in shape and comprising a major fold line and two minor fold lines, each minor fold line shared in common with an adjoining pleat, each major fold line larger in diameter than the minor fold line, and both fold lines concentric to each other so that said pleats are capable of compressing and allowing the body to collapse into a compact position upon an infant withdrawing liquid from the reservoir, preventing the infant from ingesting air, and causing the liquid dispensing pacifier to thereafter function as an infant suckling pacifier.

2. The liquid dispensing pacifier of claim 1, wherein the aperture base is removable from the body, thus exposing the reservoir and allowing said reservoir to be filled with fluid.

3. The liquid dispensing pacifier of claim 2, wherein the nipple base and aperture base are circular in shape.

4. The liquid dispensing pacifier of claim 3, wherein the resilient nipple is fixed concentrically to the nipple base.

* * * * *